US010092149B2

(12) United States Patent
Box et al.

(10) Patent No.: US 10,092,149 B2
(45) Date of Patent: Oct. 9, 2018

(54) SURFACE TREATING HEAD

(71) Applicant: Dyson Technology Limited, Wiltshire (GB)

(72) Inventors: Charles Geoffrey Box, Swindon (GB); Luke William Stephens, Swindon (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 363 days.

(21) Appl. No.: 14/664,224

(22) Filed: Mar. 20, 2015

(65) Prior Publication Data

US 2015/0265114 A1 Sep. 24, 2015

(30) Foreign Application Priority Data

Mar. 21, 2014 (GB) ..... 1405062.9

(51) Int. Cl.
*A47L 9/02* (2006.01)

(52) U.S. Cl.
CPC ..... *A47L 9/02* (2013.01)

(58) Field of Classification Search
None
See application file for complete search history.

(56) References Cited

U.S. PATENT DOCUMENTS

| | | | | |
|---|---|---|---|---|
| 1,883,327 A | | 10/1932 | Becker | |
| 2,070,688 A | | 2/1937 | Smellie | |
| 2,157,077 A | * | 5/1939 | Kroenlein | A47L 9/02 15/246 |
| 2,511,238 A | | 6/1950 | Beede | |
| 2,517,058 A | | 8/1950 | Uber | |
| 2,601,697 A | | 7/1952 | Troxler | |
| 2,664,588 A | | 1/1954 | Brace | |
| 3,936,905 A | * | 2/1976 | Stewart | A47L 9/0072 15/354 |
| 5,557,822 A | * | 9/1996 | Yagi | A47L 9/0483 15/369 |

(Continued)

FOREIGN PATENT DOCUMENTS

| | | |
|---|---|---|
| CN | 202128400 | 2/2012 |
| DE | 32 29 754 | 2/1984 |
| DE | 199 00 557 | 7/2000 |

(Continued)

OTHER PUBLICATIONS

Search Report dated Sep. 18, 2014, directed to GB Application No. 1405062.9; 1 pg.

*Primary Examiner* — Joseph J Hail
*Assistant Examiner* — Brian D Keller
(74) *Attorney, Agent, or Firm* — Morrison & Foerster LLP

(57) ABSTRACT

A surface treating head comprising a suction cavity having a suction cavity opening bounded by a front working edge and a rear working edge, at least one of the front and rear working edges being moveable between a first position in which the suction cavity opening is at a maximum and a second position in which the suction cavity opening is at a minimum, an actuating mechanism comprising a user-operable actuator for actuating at least one of the front and rear working edges between the first and second positions, and one or more air bleed vents, wherein actuation of the actuating mechanism causes the one or more air bleed vents to open and close.

25 Claims, 11 Drawing Sheets

(56) References Cited

U.S. PATENT DOCUMENTS

| | | | | |
|---|---|---|---|---|
| 6,099,661 | A | 8/2000 | Conrad | |
| 2005/0060839 | A1* | 3/2005 | Nishinaka | A47L 5/30<br>15/418 |

FOREIGN PATENT DOCUMENTS

| | | |
|---|---|---|
| EP | 0 898 924 | 3/1999 |
| GB | 488837 | 7/1938 |
| GB | 493418 | 10/1938 |
| JP | 51-136369 | 11/1976 |
| JP | 56-26041 | 3/1981 |
| JP | 57-173032 | 10/1982 |
| JP | 61-56621 | 3/1986 |
| JP | 61-164653 | 10/1986 |
| JP | 63-51822 | 3/1988 |
| JP | 2010-284353 | 12/2010 |

* cited by examiner

SURFACE TREATING HEAD

REFERENCE TO RELATED APPLICATIONS

This application claims the priority of United Kingdom Application No. 1405062.9, filed Mar. 21, 2014, the entire contents of which are incorporated herein by reference.

FIELD OF THE INVENTION

The present invention relates to a surface treating head.

BACKGROUND OF THE INVENTION

Surface treating appliances such as vacuum cleaners are usually provided with one or more surface treating heads, often referred to as cleaner heads. It is common for cleaner heads to be able to be manipulated between different "modes" of use. The different modes can, for example, allow for more effective cleaning by the surface treating head on different types of floor surface, such as carpeted or hard floors. Typically, for high cleaning performance, it is desirable to have a large suction force generated between the surface treating head and the floor surface. However, a large suction force may draw the surface treating head towards the floor with such a large force that it them becomes difficult to move the surface treating head over the floor surface.

In order to address this problem, surface treating heads are often provided with air bleeds that allow air to be drawn into the surface treating head from another part of the surface treating head which is not floor-facing. The air bleeds provide an alternative channel for air to be drawn into the surface treating head, and therefore the suction force between the surface treating head and the floor surface is reduced. These air bleeds may be permanently fixed air bleeds, or alternatively they may be able to be opened or closed by a user. For example, if a user finds it hard to move the surface treating head over a surface, they can choose to open one or more air bleeds. However, this may require stopping the cleaning operation a number of times in order to adjust the air bleeds. It can be frustrating to a user if they need to change the configurations of the air bleeds, particularly if the user cleans over a number of different types of floor surfaces in a single cleaning operation. Furthermore, it is easy for a user to forget to close air bleeds again if they move to a different floor surface. As such, it is often the case that a user will set the air bleeds once, and that they will remain in that configuration, regardless of whether it provides the best balance of cleaning performance and motion resistance.

SUMMARY OF THE INVENTION

This invention provides a surface treating head comprising a suction cavity having a suction cavity opening bounded by a front working edge and a rear working edge, at least one of the front and rear working edges being moveable between a first position in which the suction cavity opening is at a maximum and a second position in which the suction cavity opening is at a minimum, an actuating mechanism comprising a user-operable actuator for actuating at least one of the front and rear working edges between the first and second positions, and one or more air bleed vents, wherein actuation of the actuating mechanism causes the one or more air bleed vents to open and close.

As a result, when a user actuates the actuator in order to move the moveable working edge(s), the opening and closing of the air bleed vents is also controlled. Therefore, it is easier for a user to adjust the surface treating head in order to obtain the optimum balance of cleaning or pick-up performance and motion resistance. This is of particular relevance during a cleaning operation when the surface treating head is being used to clean a number of different types of floors. The user is not required to adjust both the air bleed vent openings and the moveable working edge(s) independently. Accordingly, the likelihood of the user failing to adjust the air bleed vent openings when also adjusting the moveable working edge(s), whether accidentally or otherwise, is eliminated.

The air bleed vents may be fully closed when the front and rear working edges are in the first position, and the air bleed vents may be open when the front and rear working edges are in the second position. In this way, when the suction cavity opening is at its maximum, the air bleed vents are closed, and the maximum suction can be achieved at the suction cavity opening. Whereas, when the suction cavity is at a minimum, the air bleed vents are opened and air is able to enter the suction cavity through the air bleed vents in addition to through the suction cavity opening. Accordingly, a reduced suction is achieved at the suction cavity opening, which can reduce the magnitude of resistance to motion of the surface treating head over the floor surface experienced by the user during use.

The air bleed vents may open progressively as the actuating mechanism progressively actuates at least one of the front and rear working edges from the first to second position. This can provide a greater control over the flow rate of air that is allowed to enter the suction cavity through the air bleed vents. In particular, if the actuator is adjusted by a small amount in order that the moveable rear edge(s) is subsequently only moved by a relatively small amount, this will not result in the air bleed vent being fully opened and allowing too much air to flow into the suction cavity through the air bleed vent. An air bleed vent that fully opens too quickly could result in a reduction of pick-up performance by an unnecessary or undesired amount, and so progressive opening of the air bleed vents goes some way to alleviate this.

Air may be able to be drawn into the suction cavity through the air bleed vents when the air bleed vents are open, and air may only be able to be drawn into the suction cavity through the suction cavity opening when the air bleed vents are closed. As a result, the suction power, or amount of suction, achieved at the suction cavity opening can be controlled by the opening and closing of the air bleed vents. With the opening and closing of the air bleed vents being directly linked with the actuation of the moveable working edge(s), the most suitable air bleed vent configuration can be linked with any given moveable working edge position to achieve an optimum balance of pick-up performance and motion resistance without requiring any additional input by the user.

The air bleed vents may comprise inlets that are open to the atmospheric air around the outside of the surface treating head.

The inlets for the air bleed vents may be located within one or more grooves provided in an outer surface of the surface treating head. Accordingly, the groove can provide some degree of protection against the inlet(s) being blocked by an object that may accidentally cover the area of the outer surface containing the air bleed vent inlet(s). The inlets for the air bleed vents may be provided in an upper surface of the surface treating head, which may offer some additional protection against the inlet(s) being inadvertently blocked during use. For example, if the inlet(s) was on the side of the surface treating head, then passing the surface treating head close to an object, for example a wall, may cause the inlet to be blocked.

An outlet of the air bleed vents may be located within the suction cavity between a fixed seal and a moveable working edge. The moveable edge may be in abutment with the seal when the moveable working edge is in the first position, and a clearance gap may be formed between the seal and the moveable working edge when the moveable working edge is in the second position, air being able to pass through the clearance gap from the air bleed vents into the suction cavity. Accordingly, the opening and closing of the air bleed vents is arises as a consequence of the moveable working edge moving in relation to a stationary part of the surface treating head. This provides a simple and reliable method of opening and closing the air bleed vent(s) when the moveable working edge(s) are actuated. No complex parts or mechanisms are required which helps to simplify the manufacture and assembly of the surface treating head and in turn will help to keep down the costs associated with it.

This invention further provides a vacuum cleaner comprising a surface treating head as described in any one of the preceding statements.

BRIEF DESCRIPTION OF THE DRAWINGS

In order that the present invention may be more readily understood, embodiments of the invention will now be described, by way of example, with reference to the following accompanying drawings, in which.

DETAILED DESCRIPTION OF THE INVENTION

Figure 1:
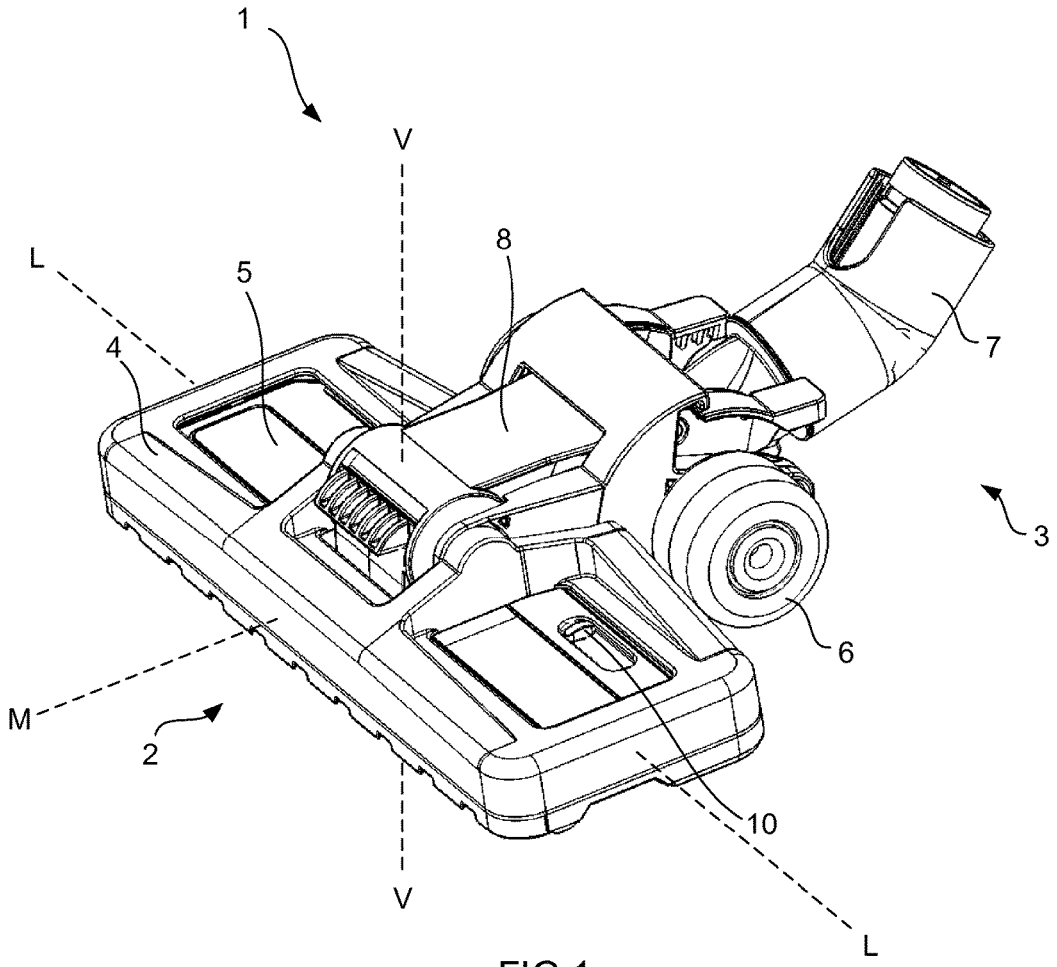
FIG. 1 is a perspective view of a surface treating head in accordance with the present invention.
Figure 2:
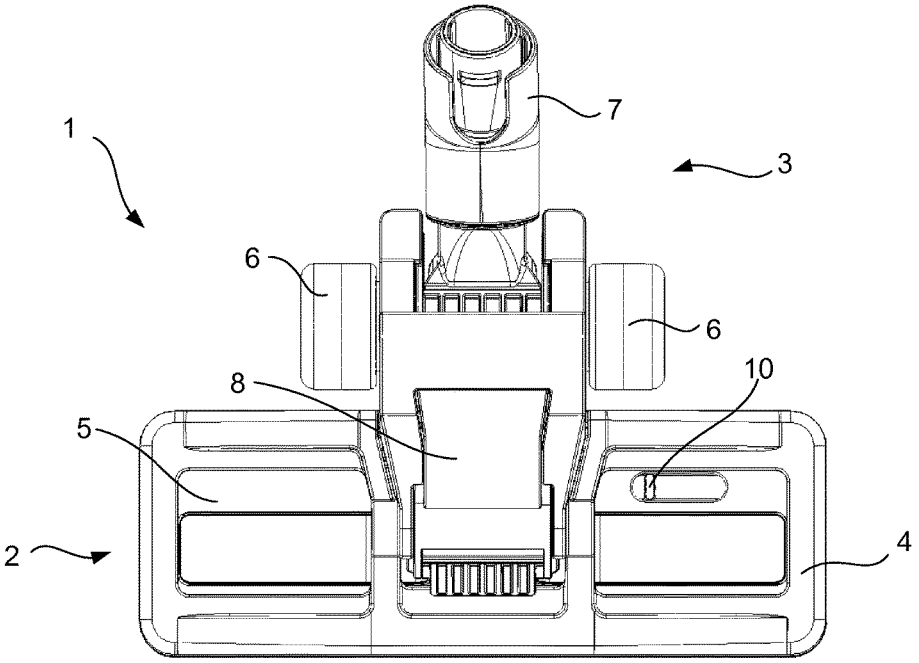
FIG. 2 is a top view of the surface treating head of FIG. 1.
Figure 3:
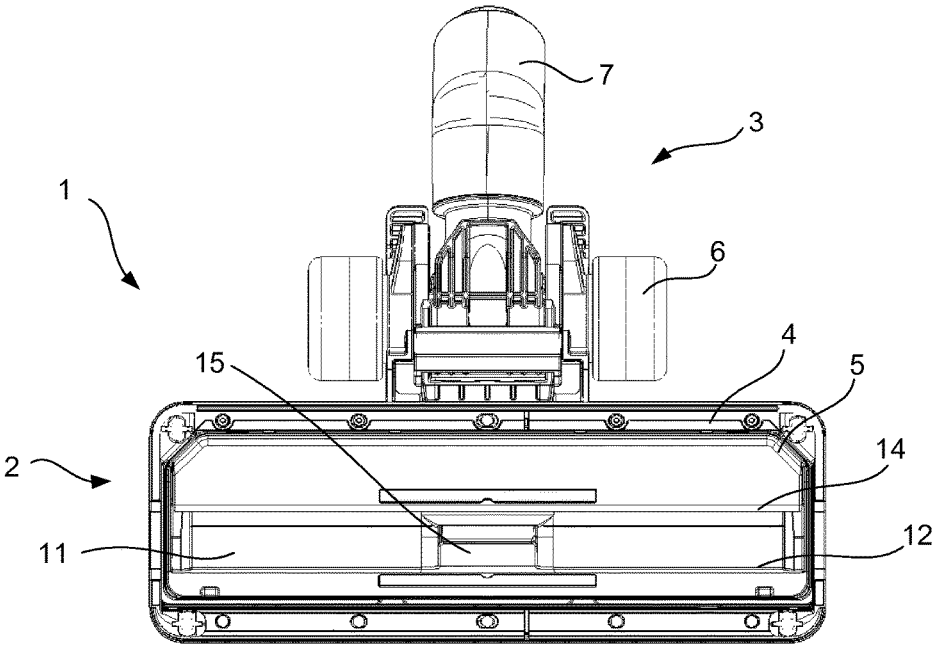
FIG. 3 is a bottom view of the surface treating head of FIGS. 1 and 2.

FIGS. 1, 2 and 3 show a surface treating head 1. The surface treating head 1 comprises a main body 2 and a rolling support 3. The main body 2 comprises an outer housing 4 that is provided around a soleplate body 5. The rolling support 3 comprises wheels 6 and a swivel duct 7. The swivel duct 7 allows the surface treating head 1 to be attached to a vacuum cleaner, for example by way of a wand attachment in the case of a cylinder- or canister-style vacuum cleaner. The swivel duct 7 is in fluid connection with the main body 2, and in particular with the soleplate body 5, by way of duct 8. FIGS. 1 and 2 also show an actuator 10 in the form of a mechanical slider that is provided on the top exposed surface of the soleplate body 5. Vertical and lateral axes of the surface treating head 1 are represented by axes V and L respectively. Axis M represents a forward direction of the surface treating head 1 during use. It can therefore be said that the axis M points forward of the front edge of the surface treating head 1.

FIG. 3 shows the underneath of the surface treating head 1. The underneath of the soleplate body 5 comprises a suction cavity 11 that has a suction cavity opening provided between a front working edge 12 and a rear working edge 14. The relative terms "front" and "rear" are defined in accordance with the direction of use of the surface treating head 1 during a forward sweep in a vacuum cleaning operation (as represented by axis M in FIG. 1). The suction cavity 11 is in fluid connection with the duct 8 by way of duct opening 15.

Figure 4:
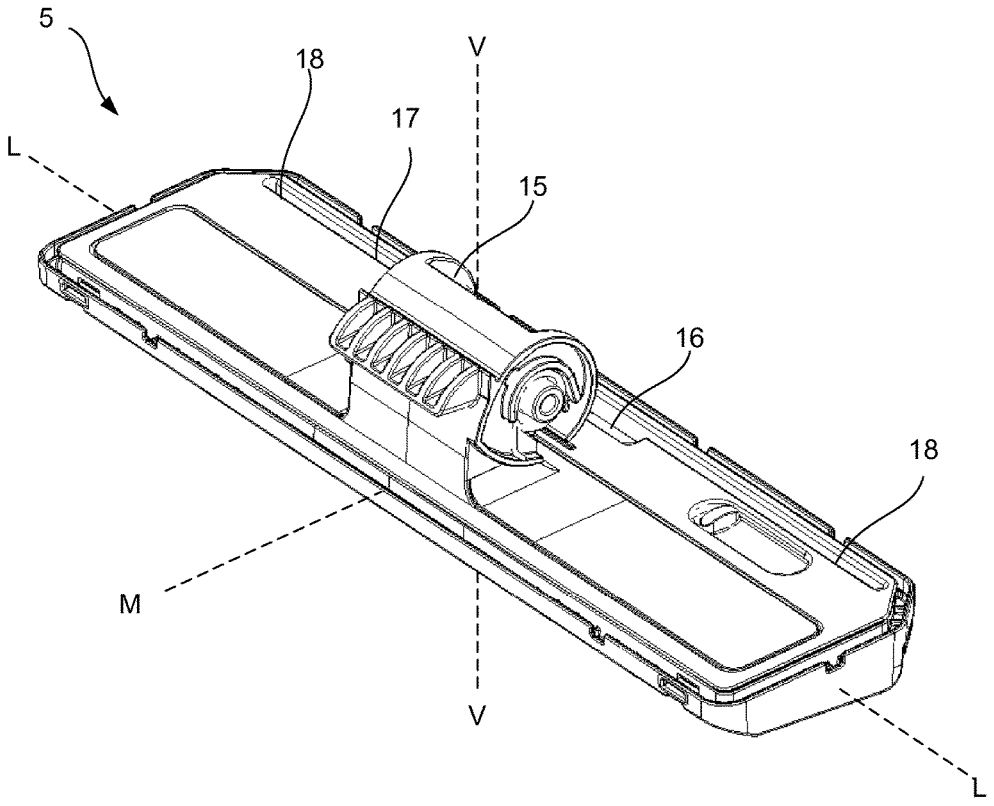
FIG. 4 is a perspective view of a soleplate body of a surface treating head in accordance with the present invention.

FIG. 4 shows just the soleplate body 5 with the remainder of the surface treating head 1 hidden from view. The duct opening 15 extends upwards from the top surface of the soleplate body 5. Behind the duct opening, towards the rear of the soleplate body 5, is a central air bleed vent 16. The outer opening for the central air bleed vent 16 is located in the central portion of a groove 17 that runs laterally across the top surface of the soleplate body 5 along a substantial portion of its width. At each end of the groove 17 there are side air bleed vents 18, the openings for which cannot be seen in FIG. 4.

The central and side air bleed vents 16 and 18 are able to fluidly connect the suction cavity 11 inside the soleplate body 5 with the air immediately surrounding the outside of the surface treating head 1. Accordingly, during use when the central and side air bleed vents 16 and 18 are opened, air is drawn into the suction cavity 11 through the air bleed vents 16, 18 as well as through the suction cavity opening between the working edges 12, 14. This has the effect of reducing the suction power produced at the suction cavity opening.

Figure 5A:
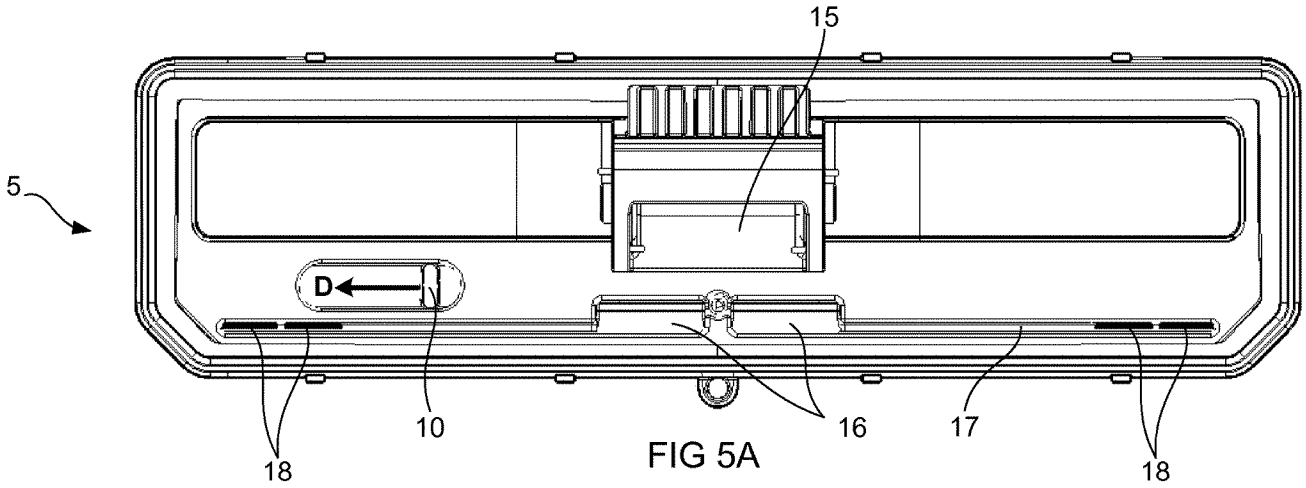
FIGS. 5A and 5B are top views of the soleplate body of FIG. 4 in a first and a second configuration.
Figure 5B:
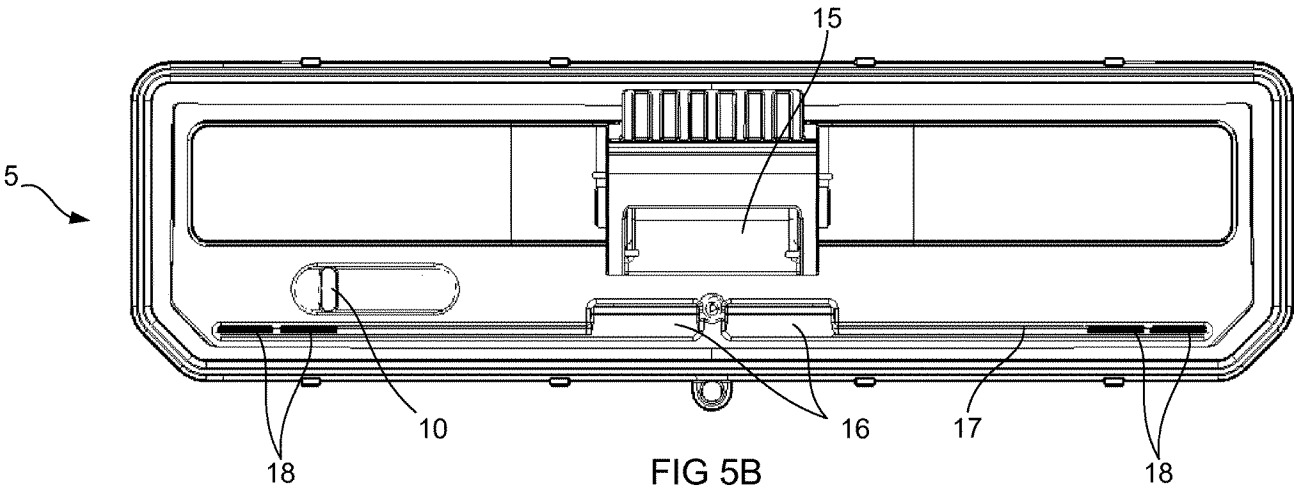

FIGS. 5A and 5B are top views of the soleplate body 5. From this view the openings of the central and side air bleed vents 16, 18 can be seen more clearly. In FIG. 5A the actuator 10 is in a first position wherein a finger grip for the actuator 10 is positioned nearest the centre of the soleplate body 5. From this first position the actuator 10 can be moved in the direction of arrow D. FIG. 5B shows the soleplate body 5 with the actuator 10 in a second position wherein the finger grip is positioned near the side edge of the soleplate body.

Figure 6A:
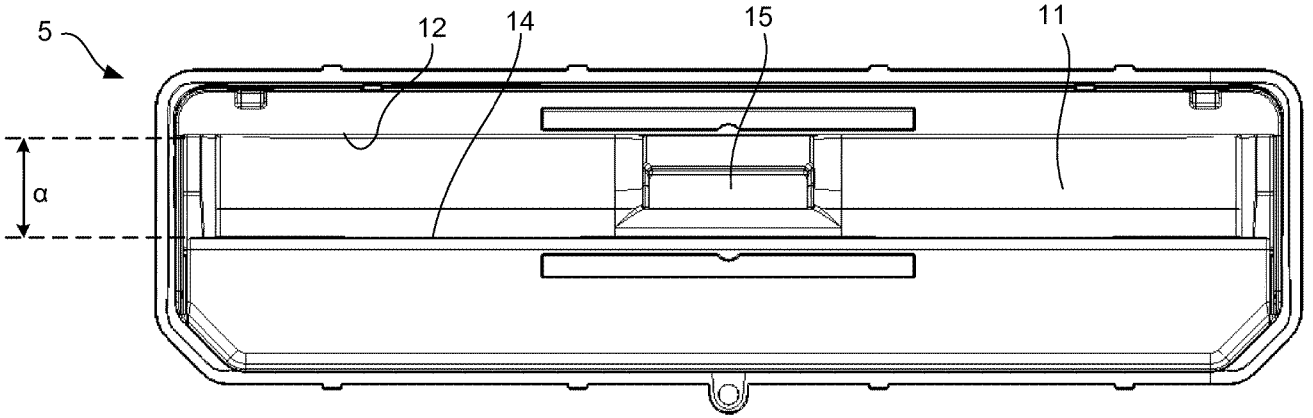
FIGS. 6A and 6B show the bottom view of the soleplate bodies in the two configurations of 5A and 5B respectively.
Figure 6B:
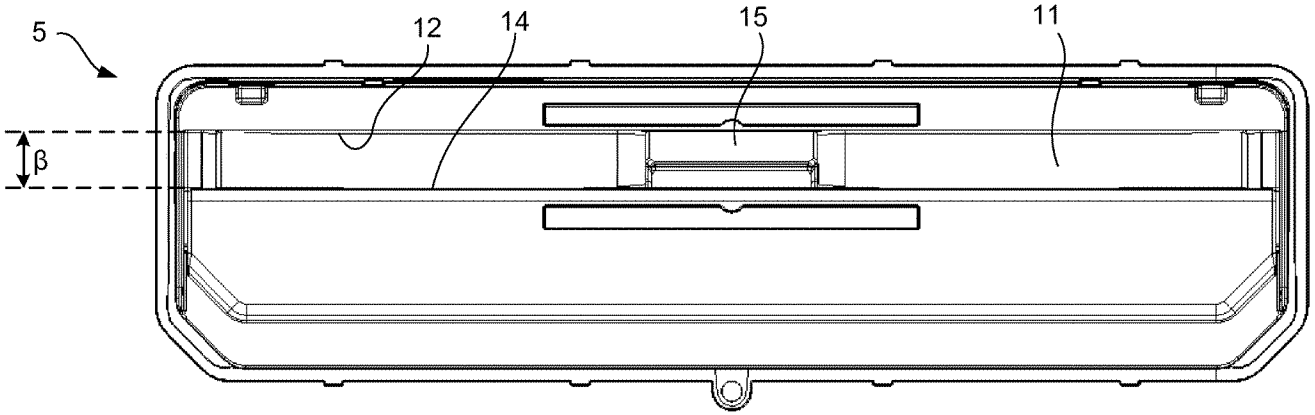

FIGS. 6A and 6B show the underneath of the soleplate body 5 when the actuator is in the two positions shown in FIGS. 5A and 5B respectively. The rear working edge 14 is moveable and is actuated by the actuator 10 such that in FIG. 6A when the actuator 10 is in the first position (as shown in FIG. 5A), the rear working edge 14 is in a first position. In this first position, the distance between the front working edge 12 and the rear working edge 14 is at a maximum, indicated by dimension α, which means that the suction cavity opening is at its greatest. Conversely in FIG. 6B, when the actuator 10 is in the second position (as shown in FIG. 5B), the rear working edge 14 is in a second position. In this second position, the distance between the front working edge 12 and the rear working edge 14 is at a minimum, indicated by dimension β, which means that the suction cavity opening is at its smallest.

When the width of the suction cavity opening is at its greatest, a, and with the central and side air bleed vents 16,18 closed, the suction force achieved at the suction cavity opening is greatly increased when the surface treating head 1 is in use. This improves the dirt pick-up performance of the surface treating head 1. However, due to the increased suction at the suction cavity opening, the surface treating head 1 may be drawn towards the floor surface with such a large force that there is a large resistance to motion. This could result with the user finding it difficult to move the surface treating head 1 over the floor surface being cleaned. On the other hand, with the width of the suction cavity opening at its smallest, β, and with the central and side air bleed vents 16, 18 open, the suction force achieved at the suction cavity opening is reduced when the surface treating head 1 is in use. This will result in a reduction in dirt pick-up performance for the surface treating head 1, but will also reduce the force with which the surface treating head 1 is drawn towards the floor surface. As such, the resistance to motion will be reduced and the user will be able to move the surface treating head over the floor surface more easily. Therefore the user is able to move the actuator 10 to switch between the two positions shown in FIGS. 5A and 5B according to their needs in regards to the dirt pick-up performance and manoeuvrability of the surface treating head 1 on different floor surfaces whilst in use.

Figure 7A:
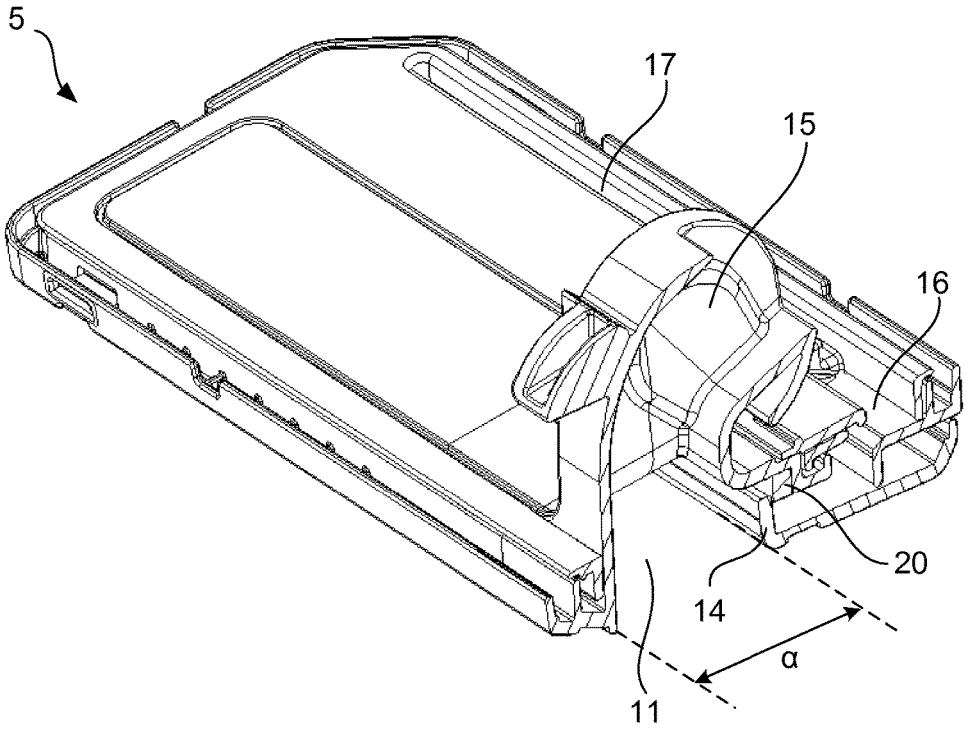
FIG. 7A shows a cross section in perspective through the soleplate body of FIG. 4 when in the configuration shown in FIGS. 5A and 6A.
Figure 7B:
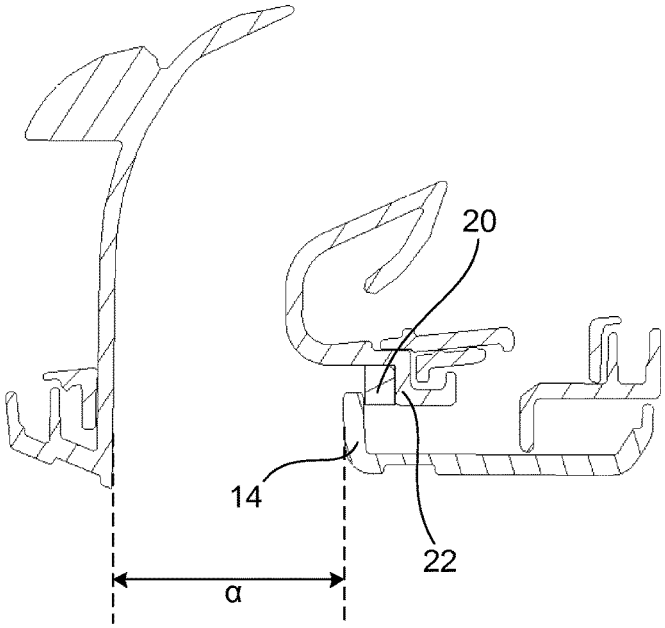
FIG. 7B shows a side view of a slice of the soleplate body at the cross section point of FIG. 7A.
Figure 8A:
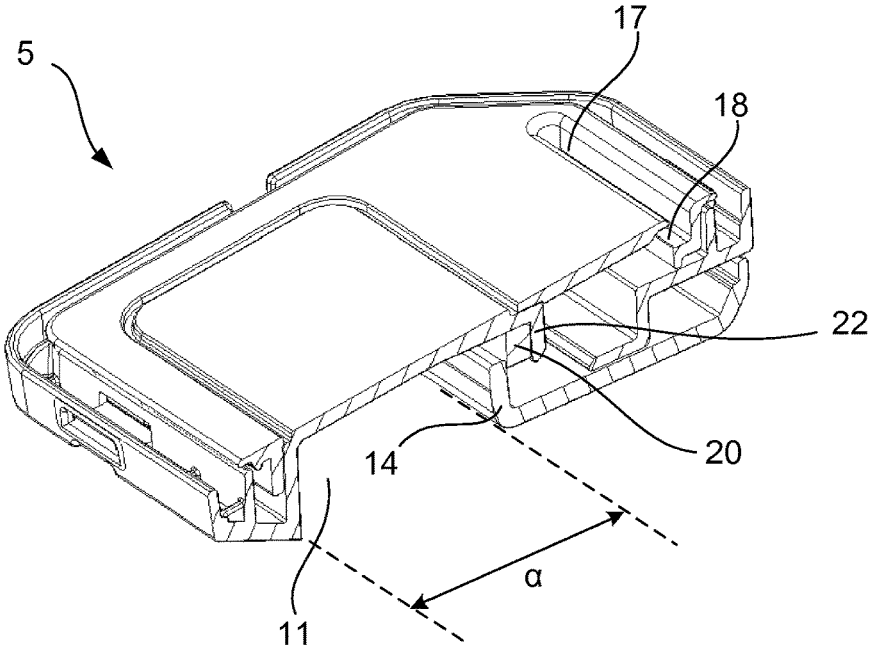
FIG. 8A shows a second cross section in perspective through the soleplate body of FIG. 4 when in the configuration shown in FIGS. 5A and 6A.
Figure 8B:
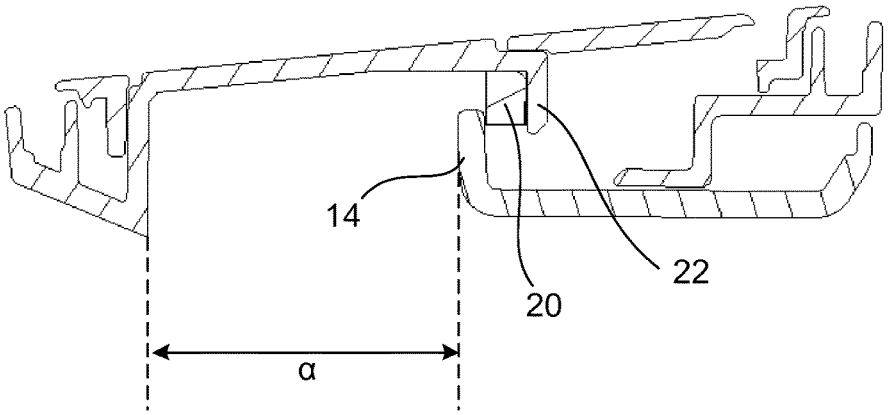
FIG. 8B shows a side view of a slice of the soleplate body at the cross section point of FIG. 8A.

FIGS. 7A and 7B, and also 8A and 8B, show cross-sections through the soleplate body 5 when the actuator 10 and moveable rear working edge 14 are both in the first positions described above and shown in FIGS. 5A and 6A. The cross-sections of FIGS. 7A and 7B are taken through the soleplate body 5 at a point where a central air bleed vent 16 is located. The cross-sections of FIGS. 8A and 8B are taken through the soleplate body 5 at a point where a side air bleed vent 18 is located. A seal 20 is provided between the moveable rear working edge 14 and a rear wall 22 of the suction cavity 11. Therefore, when the rear working edge 14 is in the first position, the rear working edge 14 comes into abutment with the seal 20 such that there is no gap between the rear working edge 14 and the seal 20. When the rear working edge is in abutment with the seal 20 in this way, air is prevented from entering the suction cavity 11 from outside the surface treating head 1 through the air bleed vents 16 or 18. Therefore when the moveable rear working edge 14 is in the first position, the air bleed vents 16 and 18 are closed. Accordingly, only air that passes through the suction cavity opening between the working edges 12, 14 can be drawn into the suction cavity 11 and subsequently through the duct opening 15, the duct 8 and swivel duct 7 into the vacuum cleaner.

Figure 9A:
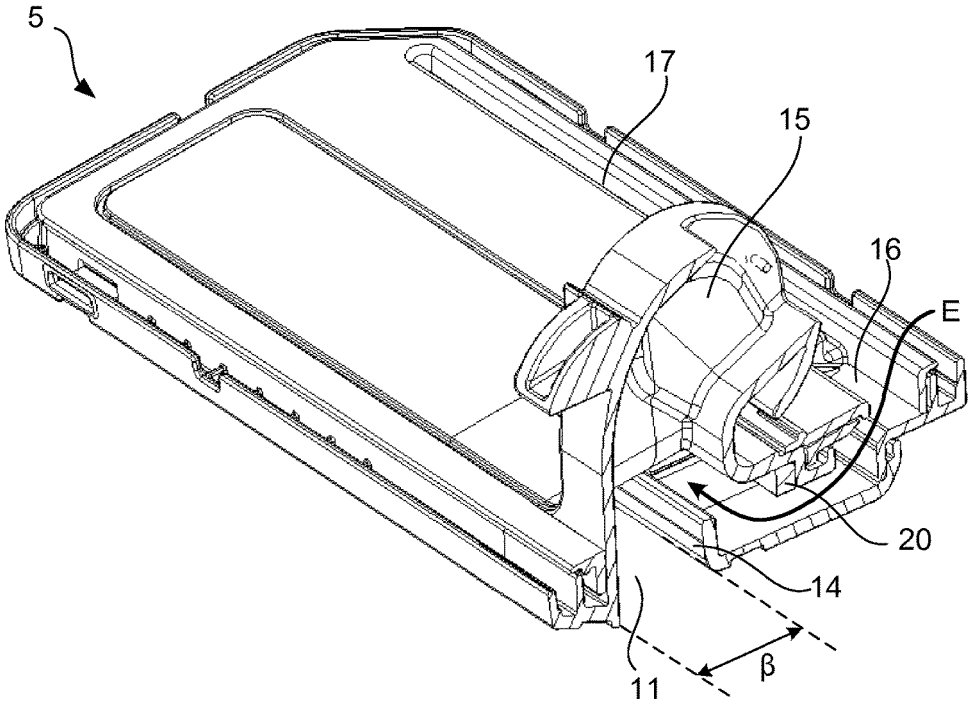
FIG. 9A shows a cross section in perspective through the soleplate body of FIG. 4 when in the configuration shown in FIGS. 5B and 6B.
Figure 9B:
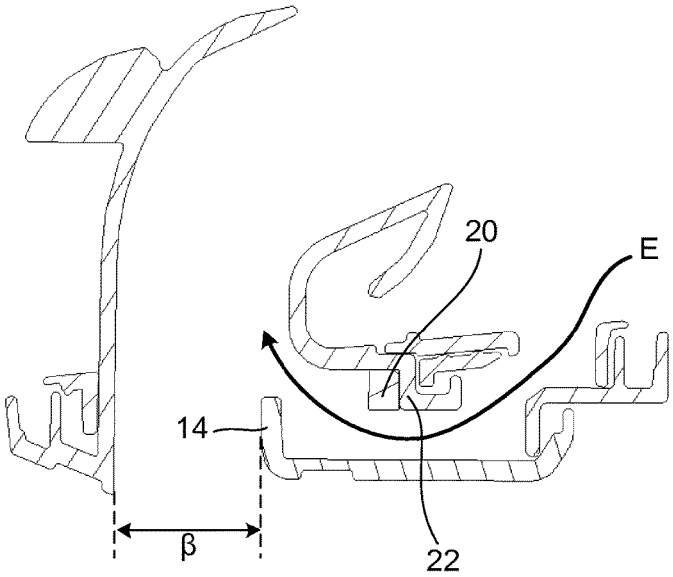
FIG. 9B shows a side view of a slice of the soleplate body at the cross section point of FIG. 9A.
Figure 10A:
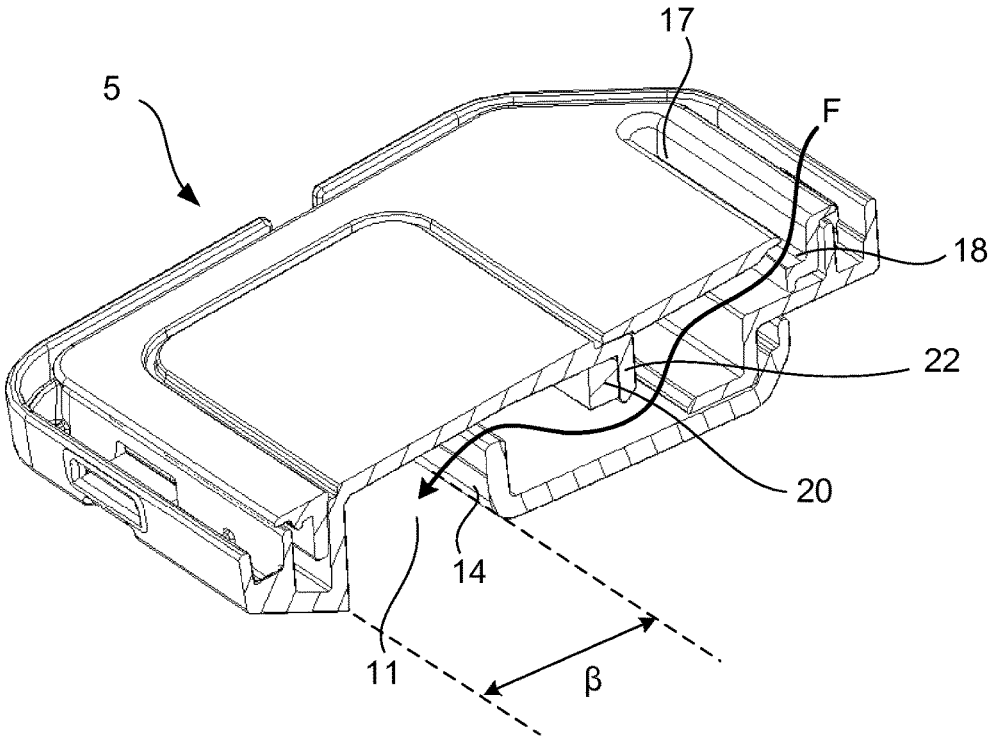
FIG. 10A shows a second cross section in perspective through the soleplate body of FIG. 4 when in the configuration shown in FIGS. 5B and 6B.
Figure 10B:
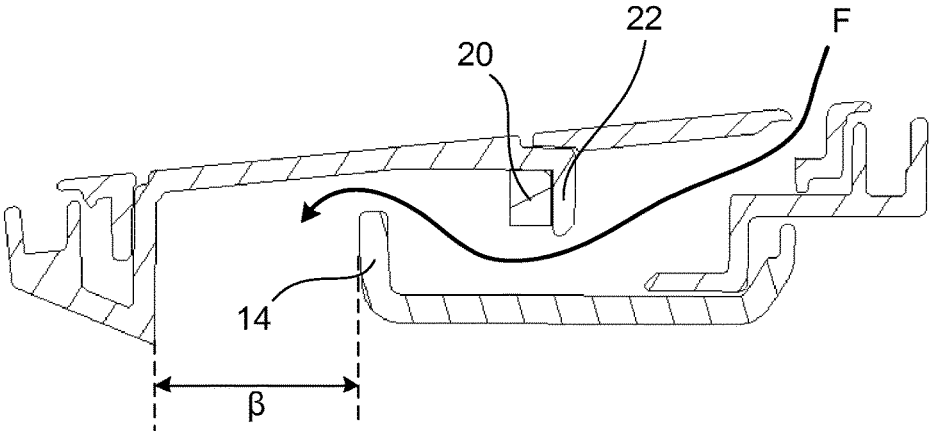
FIG. 10B shows a side view of a slice of the soleplate body at the cross section point of FIG. 10A.

FIGS. 9A and 9B, and also 10A and 10B, show cross-sections through the soleplate body 5 when the actuator and moveable rear working edge 14 are both in the second positions described above and shown in FIGS. 5B and 6B. The cross-sections shown in FIGS. 9A and 9B are taken along the same line as those shown in FIGS. 7A and 7B, i.e. at a point where a central air bleed vent 16 is located. The cross-sections shown in FIGS. 10A and 10B are taken along the same line as those shown in FIGS. 8A and 8B, i.e. at a point where a side air bleed vent 18 is located. With the moveable rear working edge 14 in the second position, it no longer abuts with the seal 20. Therefore, air is able to enter the suction cavity 11 from outside the surface treating head 1 through the air bleed vents 16, 18 as shown by arrows E and F. As air is able to enter the suction cavity 11 through a pathway other than through the suction cavity opening, the suction force at the suction cavity opening which acts to attract the surface treating head 1 to the floor surface is considerably reduced compared to when the air bleed vents 16, 18 are close as described above. Therefore, the user will experience less resistance to motion, and will be able to more easily manoeuvre the surface treating head 1 along a floor surface.

As previously described, when the rear working edge 14 is moved from the first position to the second position the air bleed vents 16, 18 are opened due to the rear working edge no longer being in contact with the seal 20 located on the rear wall 22 of the suction cavity 11. Therefore, the one user action of moving the rear working edge 14 by sliding the actuator 10 causes two resulting reactions that reduce the suction force at the suction cavity opening: the first being the reduction of the size of the suction cavity opening, and the second being the opening of the air bleed vents. A further advantage is that, because the air bleed vents are adjusted along with the moveable working edge by actuation of the same actuator, the user does not need to remember to change both the moveable edge and the air bleed vents when progressing from one floor surface type to another during a cleaning operation.

In the arrangement described above and shown in the Figures the air bleed vents 16, 18 are opened by the rear edge moving out of abutment with the seal 20. However, alternative embodiments could be envisaged that still cause air bleed vents to be opened on actuation of the actuator. For example, the front working edge 12 could be moveable, or both the front 12 and rear 14 working edges could be moveable. Therefore air bleed vents could be provided at the front or front and rear of the soleplate body 5. In a further alternative embodiment, instead of the air bleed vents being opened by a moveable working edge moving out of abutment with a seal, the air bleed vent openings could be closed by a slideable plate that is connected to the actuator 10 such that when the actuator 10 is moved, the plate slides away to reveal the air bleed vent opening.

Figure 11:
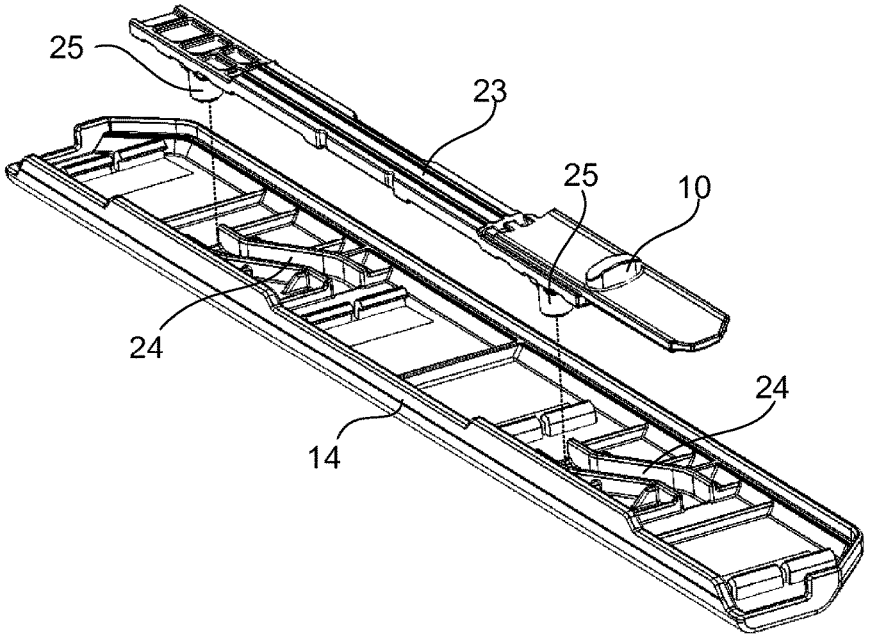
FIG. 11 shows an actuating mechanism and moveable working edge according to a first embodiment.
Figure 12:
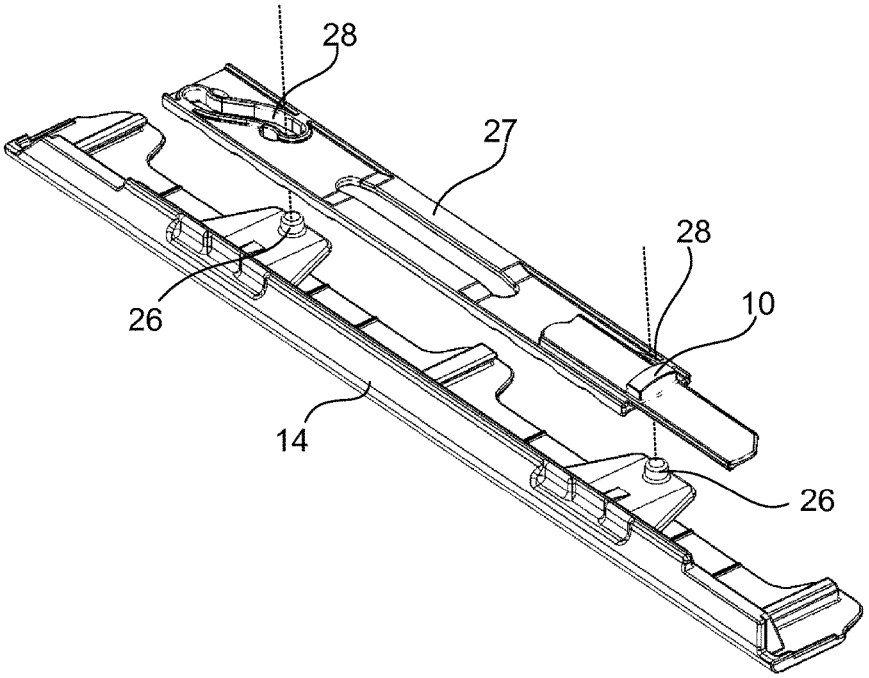
FIG. 12 shows an actuating mechanism and moveable working edge according to a second embodiment.

FIG. 11 shows a first embodiment of the actuating mechanism used to move the rear working edge 14. The mechanism comprises the rear working edge 14 and an actuator 10. The actuator 10 has a portion 23 that extends under the upper surface of the soleplate body 5 such that it is not visible during normal use. A top portion of the rear working edge 14 is provided with two channels or guide paths 24, and the actuator 10 is provided with two downwardly protruding members 25 in the form of bosses that are aligned to engage into the guide paths 24 provided on the top of the rear working edge 14. An alternative embodiment of the actuating mechanism is shown in FIG. 12, in which the rear working edge 14 is provided with upwardly protruding members 26 in the form of bosses, whereas the actuator 10, including the extended portion 27, is provided with guide paths 28 such that the upwardly protruding bosses are aligned to engage with the guide paths 28.

Figure 13A:
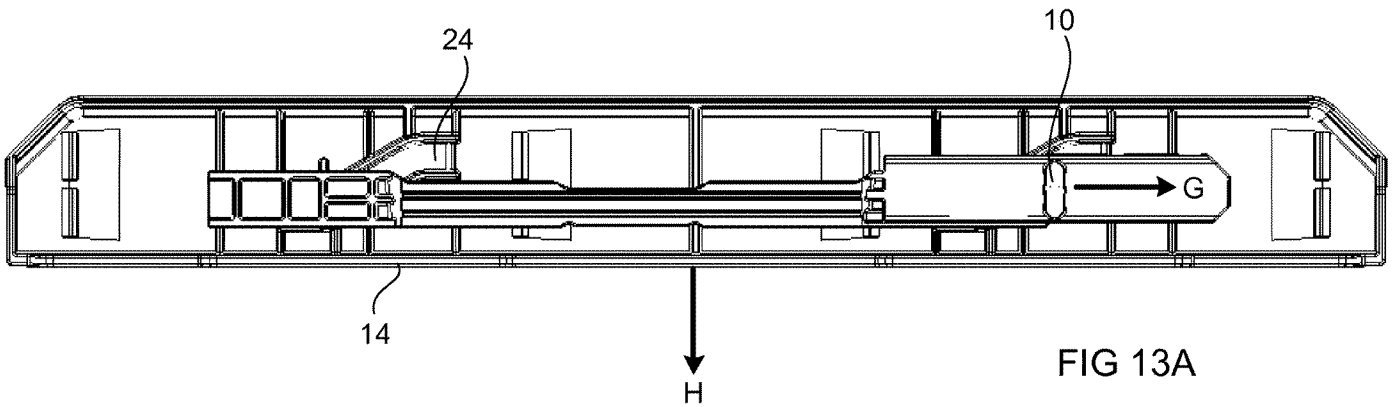
FIG. 13A is a top view of the actuating mechanism and moveable working edge of FIG. 11 in the configuration shown in FIGS. 5A and 6A.
Figure 13B:
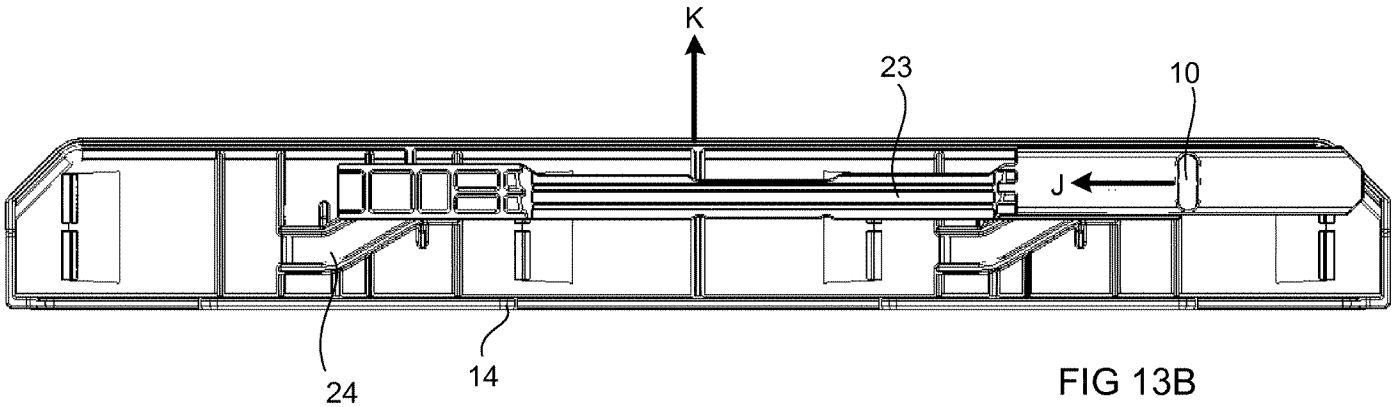
FIG. 13B is a top view of the actuating mechanism and moveable working edge of FIG. 11 in the configuration shown in FIGS. 5B and 6B.

FIGS. 13A and 13B show the actuation of the actuating mechanism of FIG. 11. When the actuator 10 is moved along a fixed straight path in the direction of arrow G (which is substantially parallel to the lateral axis L), the bosses provided on the underneath of the actuator 10 pass through the guide paths provided on the upper side of the rear working edge 14. The resulting force of the bosses on the sides of the guide paths causes the rear working edge 14 to move in the direction of arrow H (which is substantially parallel to axis M), as shown in FIG. 13A. This corresponds to the movement of the edge from the first position to the second position described above. The opposite movement is shown in FIG. 13B where movement of the actuator 10 along a fixed straight path in the opposite direction, shown by arrow J, results in the rear working edge 14 moving in the direction of arrow K. As the rear working edge is on a fixed motion path on the underneath of the soleplate body 5, the direction of actuation of the actuator 10 is orthogonal to the resulting movement of the rear working edge 14. The dimensions of the soleplate body 5 allow for a greater degree of lateral movement (i.e. parallel to axis L) on the top surface of the soleplate body, whereas the degree of movement in a front-to-back direction (i.e. parallel to axis M) would be relatively restricted. Accordingly, by arranging the actuator 10 to have a side-to-side, or lateral, direction of actuation it can be afforded a larger length of travel. Providing the actuator 10 with a relatively large length of travel compared to a smaller resulting movement of the rear working edge 14 has the result that it is easier for a user to more accurately select a desired rear working edge position and associated air bleed vent configuration. As such, it is easier for a user to achieve the optimum balance of dirt pick-up performance and motion resistance for the surface treating head 1 on any given floor type.

In the embodiments described above and shown in the figures, the guide paths 24 and 28 have a relatively straight and shallow-angled path over the length of travel of the actuator. This results in a smooth and steady resulting movement of the rear working edge 14. However, it will be appreciated that the shape of the guide paths can be designed to give rise to different types of resulting motion of the rear working edge according to the requirements of the surface treating head 1. For example, the guide paths could be provided with an unevenly curved pathway such that the initial movement of the rear working edge 14 from the first position is slow but then speeds up as it approaches the second position. This may be desirable in some circumstances, for example to stop the air bleed vents 16, 18 from opening too much too quickly.

Whilst particular embodiments have thus far been described, it will be understood that various modifications may be made without departing from the scope of the invention as defined by the claims.

The invention claimed is:

1. A surface treating head comprising:

a suction cavity having a suction cavity opening bounded by a front working edge and a rear working edge, at least one of the front and rear working edges being moveable between a first position in which the suction cavity opening is at a maximum and a second position in which the suction cavity opening is at a minimum;

an actuating mechanism comprising a user-operable actuator for actuating at least one of the front and rear working edges between the first and second positions, wherein the actuated at least one of the front and rear working edges is fixed in the same position throughout forward and rearward movement of the surface treating head; and one or more air bleed vents, wherein actuation of the actuating mechanism causes the one or more air bleed vents to open and close.

2. The surface treating head of claim 1, wherein the one or more air bleed vents are fully closed when the front and rear working edges are in the first position, and the one or more air bleed vents are open when the front and rear working edges are in the second position.

3. The surface treating head of claim 2, wherein the one or more air bleed vents open progressively as the actuating mechanism progressively actuates at least one of the front and rear working edges from the first to second position.

4. The surface treating head of claim 1, wherein the one or more air bleed vents open progressively as the actuating mechanism progressively actuates at least one of the front and rear working edges from the first to second position.

5. The surface treating head of claim 1, wherein air can be drawn into the suction cavity through the one or more air bleed vents when the air bleed vents are open.

6. The surface treating head of claim 1, wherein air can only be drawn into the suction cavity through the suction cavity opening when the one or more air bleed vents are closed.

7. The surface treating head of claim 1, wherein the one or more air bleed vents comprise at least one inlet that is open to the atmospheric air around the outside of the surface treating head.

8. The surface treating head of claim 7, wherein the at least one inlet of the one or more air bleed vents is located within one or more grooves provided in an outer surface of the surface treating head.

9. The surface treating head of claim 8, wherein the at least one inlet of the one or more air bleed vents is provided in an upper surface of the surface treating head.

10. The surface treating head of claim 7, wherein the at least one inlet of the one or more air bleed vents is provided in an upper surface of the surface treating head.

11. The surface treating head of claim 1, wherein an outlet of the one or more air bleed vents is located within the suction cavity between a fixed seal and at least one of the front and rear working edges that is moveable.

12. The surface treating head of claim 11, wherein the at least one of the front and rear working edges that is moveable is in abutment with the seal when the at least one of the front and rear working edges that is moveable is in the first position, and a clearance gap is formed between the seal and the at least one of the front and rear working edges that is moveable when the at least one of the front and rear working edges that is moveable is in the second position, air being able to pass through the clearance gap from the one or more air bleed vents into the suction cavity.

13. A vacuum cleaner comprising:

a surface treating head attached to a wand of the vacuum cleaner, the surface treating head comprising:

a suction cavity, the suction cavity having a suction cavity opening bounded by a front working edge and a rear working edge, at least one of the front and rear working edges being moveable between a first position in which the suction cavity opening is at a maximum and a second position in which the suction cavity opening is at a minimum;

an actuating mechanism comprising a user-operable actuator for actuating at least one of the front and rear working edges between the first and second positions, wherein the actuated at least one of the front and rear working edges is fixed in the same position throughout forward and rearward movement of the surface treating head; and one or more air bleed vents, wherein actuation of the actuating mechanism causes the one or more air bleed vents to open and close.

14. A surface treating head comprising:

a suction cavity having a suction cavity opening bounded by a front working edge and a rear working edge, at least one of the front and rear working edges being moveable between a first position in which the suction cavity opening is at a maximum and a second position in which the suction cavity opening is at a minimum;

an actuating mechanism comprising a user-operable mechanical slider configured for sliding across a surface of the surface treating head and actuating at least one of the front and rear working edges between the first and second positions; and one or more air bleed vents, wherein actuation of the actuating mechanism causes the one or more air bleed vents to open and close.

15. The surface treating head of claim 14, wherein the one or more air bleed vents are fully closed when the front and rear working edges are in the first position, and the one or more air bleed vents are open when the front and rear working edges are in the second position.

16. The surface treating head of claim 15, wherein the one or more air bleed vents open progressively as the actuating mechanism progressively actuates at least one of the front and rear working edges from the first to second position.

17. The surface treating head of claim 14, wherein the one or more air bleed vents open progressively as the actuating mechanism progressively actuates at least one of the front and rear working edges from the first to second position.

18. The surface treating head of claim 14, wherein air can be drawn into the suction cavity through the one or more air bleed vents when the air bleed vents are open.

19. The surface treating head of claim 14, wherein air can only be drawn into the suction cavity through the suction cavity opening when the one or more air bleed vents are closed.

20. The surface treating head of claim 14, wherein the one or more air bleed vents comprise at least one inlet that is open to the atmospheric air around the outside of the surface treating head.

21. The surface treating head of claim 20, wherein the at least one inlet of the one or more air bleed vents is located within one or more grooves provided in an outer surface of the surface treating head.

22. The surface treating head of claim 21, wherein the at least one inlet of the one or more air bleed vents is provided in an upper surface of the surface treating head.

23. The surface treating head of claim 20, wherein the at least one inlet of the one or more air bleed vents is provided in an upper surface of the surface treating head.

24. The surface treating head of claim 14, wherein an outlet of the one or more air bleed vents is located within the suction cavity between a fixed seal and at least one of the front and rear working edges that is moveable.

25. The surface treating head of claim 24, wherein the at least one of the front and rear working edges that is moveable is in abutment with the seal when the at least one of the front and rear working edges that is moveable is in the first position, and a clearance gap is formed between the seal and the at least one of the front and rear working edges that is moveable when the at least one of the front and rear working edges that is moveable is in the second position, air being able to pass through the clearance gap from the one or more air bleed vents into the suction cavity.

* * * * *